United States Patent [19]

Grosso et al.

[11] Patent Number: 4,676,574

[45] Date of Patent: Jun. 30, 1987

[54] EXPLOSION AND FLAME PROOF ELECTRICAL CONNECTOR PROTECTIVE ASSEMBLY

[75] Inventors: Donald S. Grosso, West Hartford; Brian V. Park, Portland, both of Conn.

[73] Assignee: Teleco Oilfield Services Inc., Meriden, Conn.

[21] Appl. No.: 865,158

[22] Filed: May 20, 1986

Related U.S. Application Data

[63] Continuation of Ser. No. 675,966, Nov. 28, 1984, abandoned.

[51] Int. Cl.[4] ..... H01R 13/52

[52] U.S. Cl. ..... 439/271; 439/521; 439/753

[58] Field of Search ..... 339/94 R, 94 A, 94 C, 339/94 M, 102 R, 139 R, 139 C, 140 R, 140 C, 116 R, 116 C

[56] References Cited

U.S. PATENT DOCUMENTS

| | | | |
|---|---|---|---|
| 2,703,870 | 3/1955 | Minto | 339/94 M |
| 3,406,371 | 10/1968 | Buckeridge | 339/94 M |
| 3,643,208 | 2/1972 | Massa, Jr. | 339/102 R |
| 3,711,815 | 1/1973 | Pierce et al. | 339/94 M |
| 4,060,299 | 11/1977 | Williams | 339/94 R |

*Primary Examiner*—John McQuade

*Attorney, Agent, or Firm*—Fishman & Dionne

[57] ABSTRACT

An explosion and flame proof electrical connector protective assembly is presented which comprises an explosion proof cylindrical housing threadably connected at each end to explosion proof gland members. A pair of disconnectable conventional, i.e. non-explosion proof, connector elements, each leading from ends of respective cables, are disposed and connected within the housing and gland members. Both gland members are tightly sealed to the respective cables forming a protective explosion proof environment within the housing for the attached connector elements. The protective assembly of the present invention is especially well suited for use in extremely hazardous environments such as Class 1, Division 1 hazardous areas as defined by the National Electric Code (NEC) and which are associated with oil rigs and the like.

9 Claims, 2 Drawing Figures

EXPLOSION AND FLAME PROOF ELECTRICAL CONNECTOR PROTECTIVE ASSEMBLY

This application is a continuation of application Ser. No. 675,966, filed 11/28/84, now abandoned.

BACKGROUND OF THE INVENTION

This invention relates to an explosion and flame proof electrical connector protective assembly. More particularly, this invention relates to a new and improved explosion and flame proof electrical connector protective assembly which is especially suitable for use in extremely hazardous environments such as, for example, Class 1, Division 1 and 2 hazardous areas associated with oil rigs and the like.

Off-shore oil rigs and the like present many difficult problems in terms of worker safety, fire and explosion prevention, etc. In fact, it is well known that such rigs can be quite hazardous due to the flammable gasses and liquids which are commonly associated with the oil drilling art. Specifically, certain areas in and around an oil rig platform are deemed more hazardous or dangerous in terms of fire and explosion possibilities than other areas. Thus, locations on a rig are typically divided into several hazardous categories.

In the United States, the classification of such hazardous areas are set forth by the National Electric Code (NEC). The areas of greatest danger are termed Class 1, Division 1 and Class 1, Division 2 areas or locations. Class 1 locations are those in which flammable gasses or vapors are or may be present in the air in quantities sufficient to produce explosive or ignitable mixtures. Other countries have promulgated similar classifications. For example, in Europe, the classifications are set by the International Electrotechnical Committee (IEC) defining a Zone 1 area as roughly equivalent to Class 1, Division 1 area with Zone 2 being similar to Class 1, Division 2. The IEC also has a Zone 0 which can be included in Class 1, Division 1 under NEC classifications. It should be understood that for the sake of simplicity and for the purposes of this patent application, a discussion of "classified hazardous areas" or "Class 1, Division 1 areas" will encompass all of the well known names for such hazardous areas.

Electrical components and other equipment located in an area classified as hazardous (i.e., Class 1, Division 1 or Zone 1) must be designed to meet rigorous and comprehensive International or U.S. safety regulations and standards before they can be used therein. In fact, a component must undergo a thorough certification procedure by an applicable testing facility by Underwriter's Laboratory (U.L.) or British Approvals Service for Electrical Equipment and Flammable Atmosphere (BASEEFA) for example, to assure that the components do meet the requirements of organizations such as the NEC or IEC. This certification procedure is principally aimed at assuring flame and explosion proof protection. It follows then, that an uncertified component, such as an uncertified electrical connector, cannot be used in Class 1, Division 1 or similar hazardous areas.

As mentioned above, in a Class 1, Division 1 area on oil rigs and the like, only certified electrical connectors and other components may be used therein due to the hazards posed by disconnections and the risks of resultant sparks and explosions. However, it is well known to those skilled in the art that practical and commercially economical "certified" connectors for instrumentation are not presently available. Those commercial explosion proof connectors which are availabe are excessively large, expensive and limited to power circuits with a limited number of wires. Typically, electrical connections between a pair of cables or a cable and electric or electronic components are effected in one of two ways. A first method (which is also most commonly utilized) is to directly wire (i.e., hardwire) cables and components and so avoid any separate connector structure. However, hardwiring suffers from several drawbacks including expensive, labor intensive assembly; and difficult, time consuming and expensive location and repair of damaged equipment. It will be appreciated that if even one component or circuit malfunctions, then the entire assembly must be disassembled and re-wired. Thus, hardwiring can typically or at least potentially be quite unreliable and undesirable especially in portable or reconfigurable situations.

A second method of effecting an electrical connection in a Class 1, Division 1 hazardous area of an oil rig or the like is to enclose standard uncertifiable connectors within a conventional explosion proof box. However, the use of such a standard, well-known explosion proof box is undesirable for a variety of reasons. For example, such conventional boxes are quite large, bulky and unwieldy and hence, become a mechanical design constraint. This is especially true as Class 1, Division 1 areas on oil rigs often necessitate electrical connections in tight areas of limited space. Also, conventional explosion-proof boxes are usually constructed of cast iron and necessitate a large heavy cover which is bolted on the box. Obviously, the heavy cast iron construction is undesirable as is the use of a separate cover since the cover is often complicated and may require the presence of a seal and/or accurately machined surfaces.

SUMMARY OF THE INVENTION

The above-mentioned and other problems and disadvantages of the prior art are overcome or alleviated by the explosion and flame proof connector potective assembly of the present invention. In accordance with the present invention, a flame and explosion proof electrical connector protective assembly is provided which is especially suitable for use in extremely hazardous environments such as, for example, a Class 1, Division 1 hazardous area associated with oil rigs and the like.

The electrical connector protective assembly of the present invention comprises a "certified" explosion proof cylindrical tube or housing which is threaded at both ends to threadably engage a pair of "certified" explosion-proof glands. The glands are mounted on electrical cables, and the end of each cable has a permanent conventional electrical connector to mate with the connector on the other cable. Thus, in accordance with the present invention, the conventional uncertifiable connectors are disposed within the cylindrical tube. Thereafter, both glands are tightened over a molded rubber boot at the end of each cable. By using cylindrical tubes and glands of diffeerent sizes, connectors of various sizes or types may be used in hazardous classified areas.

In a first embodiment of the present invention, installation of the protector is made by slipping the preassembled housing (which includes the tube and the glands) over one section of cable before connection, thereafter attaching the conventional connectors to each other, and then slipping the housing back over the connection and tightening the glands as described above. In second embodiment of the invention, the glands are attached to the cable ends which do not have a molded boot, and the housing is assembled after the cable connectors have been joined.

The present invention provides many features and advantages over the prior art. For example, the instant invention eliminates the need for undesirable hardwiring of components. Also, the present invention eliminates the need for large, bulky prior art boxes, and the generally cylindrical shape of the protective assembly also eliminates the need for the highly problematic covers and associated gaskets and bolts of prior art devices.

Thus, the present invention will permit non-certifed connectors to be easily used in Class 1, Division 1 and similar hazardous areas; allows quick rig up of electronic and other components; and improve reliability of installation as well as simplifying repair work and alterations. Finally, this invention also allows for form, fit and functional compatibility with existing equipment and may also be utilized in Class 1, Division 2 and other hazardous areas as well as Class 1, Division 1 areas on an oil rig or the like.

The above-discussed and other advantages of the present invention will become apparent to and understood by those skiled in the art from the following detailed description and drawings.

BRIEF DESCRIPTION OF THE DRAWINGS

Referring now to the drawings, wherein like elements are numbered alike in the several.

DESCRIPTION OF THE PREFERRED EMBODIMENT

Figure 1:
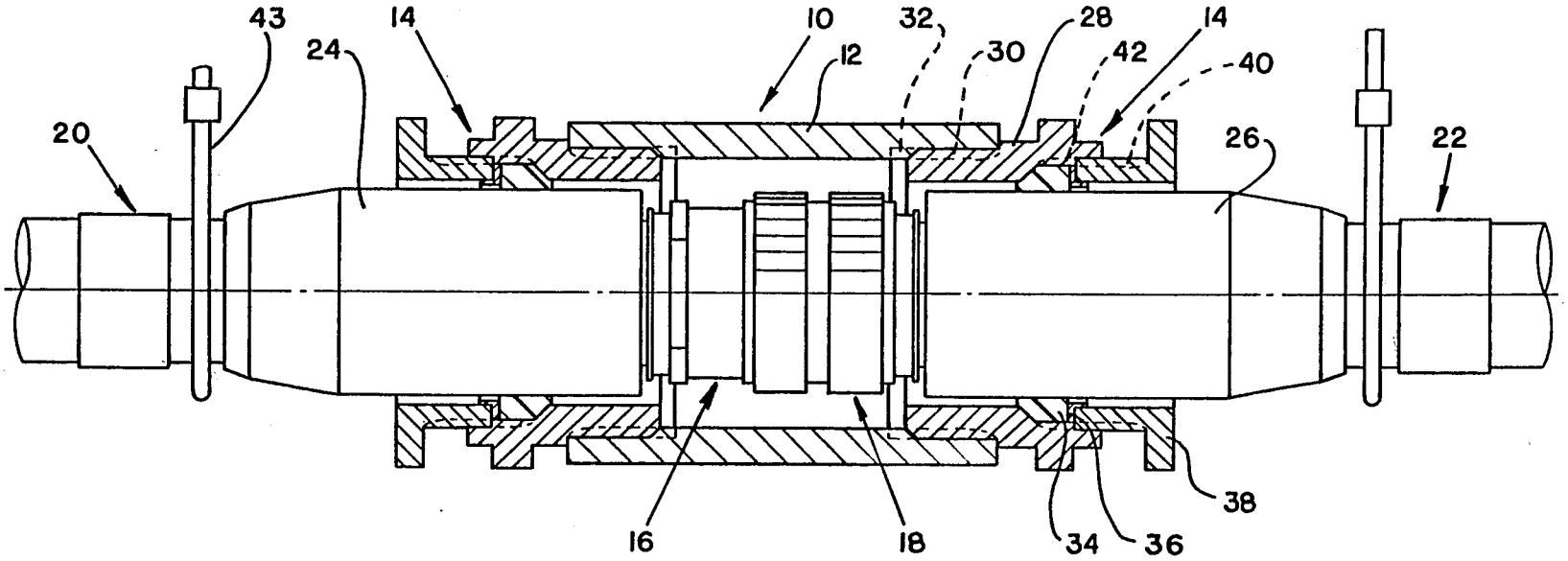
FIG. 1 is an elevation view, partly in cross-section, of a first embodiment of an electrical connector protective assembly in accordance with the present invention.

Referring first to FIG. 1, an electrical connector protective assembly in accordance with the present invention is shown generally at 10. Protective assembly 10 essentially comprises a cylindrical, thick-walled, explosion proof housing or tube 12 threadably engaged to explosion proof glands 14, at either end thereof. Positioned within housing 12 is a conventional uncertifiable electrical connector comprised of disconnectable first and second connector elements 16 and 18 which, for example, may be of the pin/receptacle type. Each connector element 16 and 18 is directly and permanently connected to an electrical cable 20 and 22, respectively, which, in turn, leads to or from any suitable electrical or electronic component. Appropriately sized hubs or boots 24 and 26 are each integrally molded to the ends of the cables 20, 22 in the vicinity of the protective assembly 10 to provide the cable with an adequate diameter to effect a tight and secure connection with each of glands 14. Hubs or boots 24, 26 also act to fill any void behind the connector to prevent the passage of any hot gases from an explosion inside the housing from traveling down the inside of the cable. The sealing function of boots 24 and 26 is an important feature thereof in terms of acquiring necessary "certification" as was discussed above.

Still referring to FIG. 1, each gland 14 of connector protective assembly 10 is comprised of a flanged gland housing 28 which has external threading 30 at one end thereof to engage the internal threading 32 on each end of housing 12. Each gland 14 also includes a cylindrical inner seal 34 comprised of a suitable elastomeric material such as neoprene, a cylindrical skid washer 36 and a cylindrical flanged compression nut 38. Compression nut 38 is provided with suitable threading 40, which threadably engages internal threading 42 at a second end of gland housing 28. Thus, as compression nut 38 threadably engages and is tightened within gland housing 28, skid washer 36 is urged against seal 34 thereby compressing the seal 34 between the gland housing 28 and molded hub 26. The outer diameter of hub 26 must be the same as or larger than the outer diameter of connector elements 16 and 18 in order to permit the fully assembled housing (including the glands) to be slid over the assembled connectors. It will be appreciated to those skilled in the art that explosion-proof glands of the type shown at 14 are readily commercially available. An example of such a gland is sold by R. Stahl Company of Woburn, Mass.

The explosion-proof cylindrical housing 12 of protective assembly 10 may be comprised of brass, steel, glass reinforced plastic or any other suitable material. Note that the dimensions of housing 12 will be depend on the size of the connector elements and cables which are to be disposed therein. Thus, the dimensions of housing 12 (and glands 14) will vary depending upon the size of the interior components to be protected. Note also that the thickness of the various walls of housing 12 and glands 14 will depend upon the applicable requirements for explosion-proof certification. In FIG. 1, reference numeral 43 identifies a conventional dust cap retaining cable.

The embodiment of FIG. 1 has the feature and advantage that the assembly can be preassembled, then slid over one cable section, and then secured to the molded boots by compressing the gland seals after the conventional connectors are joined; and, access can be had to the connectors for separation and/or reconnection without unmaking the parts of the housing. This is achieved by merely loosening the nuts 38 enough to uncompress the seals 34 and then sliding the entire assembly (housing 12, gland housings 28, seals 36 and nuts 38) over one cable section.

Figure 2:
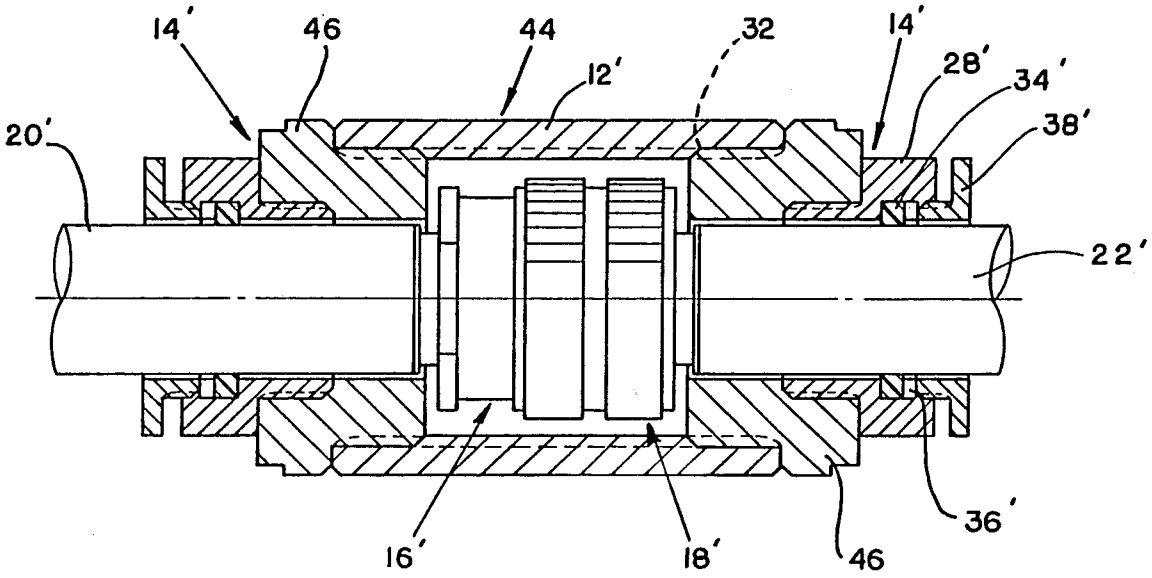
FIG. 2 is an elevation view, partly in cross-section, of a second embodiment of an electrical connector protective assembly in accordance with the present invention.

Referring now to FIG. 2, a second embodiment of an electrical connector protective assembly in accordance with the present invention is shown generally at 44. Protective assembly 44 of FIG. 2 is similar to the assembly 10 of FIG. 1 and so similar or identical elements have been given the same reference numeral with the addition of a prime superscript. The major difference between the embodiments of FIGS. 1 and 2 is that the FIG. 2 embodiment does not necessitate the molded cylindrical hub or boot structure 24 and 26 of FIG. 1. Thus, in FIG. 2, cables 20' and 22' are directly wired to connector elements 16' and 18' without the inclusion of a hub 24, 26. However, an additional gland adapter 46, which may be a separate piece or integrally attached to glands 14, is provided in the embodiment of FIG. 2 to effect connection between glands 14' and housing 12'. It should be appreciated that in FIG. 2, gland adapter 46 is threadily (and so detachably) attached to glands 14' and housing 12'. A feature of the FIG. 2 embodiment is that it uses the thread of the glands for a flamepath thus eliminating the need of lids or covers with flamepaths as has been necessary in the prior art.

In the FIG. 2 embodiment, connectors having their own mechanical sealing on the cable may be used. The FIG. 2 embodiment is thus useful where, molding of the hub is not possible. A major advantage of this embodiment is that field repair of the connector is permitted. However, a drawback to the FIG. 2 embodiment is that the glands are permanently retained on the cables, thereby limiting the cables universality.

As mentioned, the embodiment of the present invention shown in FIG. 2 has the advantage over the FIG. 1 embodiment in that no special hub structure need be molded on cables 20, 22'. However, disassembly of the protector assembly of the FIG. 2 embodiment requires unmaking the connection between sleeve 12' and one of the gland adapters 46 (since the gland adapters cannot slide over connector elements 16', 18'). Conversely, in the embodiment of FIG. 1, disassembly of the protector assembly can be effected without unmaking the housing merely by loosening the compression nuts 38 and sliding the entire assembly over one cable part. Thus, each embodiment has its particular advantages. However, the embodiment of FIG. 1 is preferred because of its convenience as a simple add-on.

The electrical connector protective assembly of the present invention provides many features and advantages heretofore not found in the prior art. The present invention is especially suitable for use in extremely hazardous environments such as Class 1, Division 1 or similar hazardous areas associated with oil rigs and similar environmental conditions. Accordingly, the instant invention eliminates the need for the heretofore commonly used hardwire connection method in such hazardous areas. Thus, the problems associated therewith including expensive and difficult assembly and repair and overall unreliability are no longer present. Also, the present invention eliminates the need for the use of large, bulky and heavy prior art explosion proof boxes by providing a protective assembly which is smaller and less bulky (i.e., takes up a smaller volume and which is of relatively lighter weight (due to the smaller volume). Moreover, and of particular importance, the cylindrical shape of the housing portion of the instant invention eliminates the need for the highly problematic box cover, gaskets and bolts of the prior art. Accordingly, important features of the instant invention include not only the use of fewer parts and therefore less expensive but also greater reliability, less assembly time and improved safety.

An important feature of the present invention is that uncertifiable, non-intrinsic safe electrical connectors may be utilized in Class 1, Division 1 and similarly hazardous areas. The instant invention will therefore permit quick rig-up of electronic and other components and overall improved reliability as compared to the prior art.

Another feature of this invention is that repair work, exchange of faulty equipment and other labor intensive (and expensive) procedures will be rendered easier and quicker by use of the conventional connector elements in association with the protective assembly described herein.

Finally, the instant invention allows for form, fit and functional compatibility with existing equipment and cables, and so may be used in less hazardous areas as well as Class 1, Division 1 type areas. Thus, the present invention provides commonality of parts and affords economic savings.

It should be appreciated that while the present invention has been described in terms of its application in connection with oil rigs and similar hazardous environments, the teaching herein are applicable to any application wherein a protective explosion and flame proof assembly is needed in association with non-explosion proof electrical connectors.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An explosion and flame proof electrical connector protective assembly for protecting a pair of conventional connector elements in an extremely hazardous environment, said connector elements being normally unsuitable for use in extremely hazardous environments, said connector elements respectively being attached to first ends of a pair of cables to be connected, the protective assembly comprising:

an explosion proof cylindrical housing, said housing including an outer surface and an inner surface, said outer surface being free of threads and said inner surface including internal threads at both ends thereof, said cylindrical housing having openings at both of said ends while the rest of said cylindrical housing defines a one-piece, unitary explosion proof enclosure;

a pair of explosion proof cylindrical gland means, each of said gland means having first external threads at one end thereof to threadably engage said internal threads at each respective end of said housing;

cylindrical sealing means in each of said gland means to effect an explosion proof seal about each of said cables; and wherein said protective assembly is adapted to surround the conventional connector elements defining an empty void between said cylindrical housing and the conventional connector elements and wherein said protective assembly is separable, independent and distinct from the conventional connector elements.

2. The assembly of claim 1 wherein said each of said gland means includes:

cylindrical gland housing means, said gland housing means comprising a flanged element having first and second threads, said first gland housing means threads threadably engaging said explosion proof cylindrical housing;

cylindrical compression nut means having threads thereon to threadingly engage said second threads on said gland housing means; and said cylindrical sealing means being positioned between said compression nut means and said gland housing means wherein said compression nut means may be tightened within said gland housing means to urge said sealing means into a compressive seal with the cables.

3. The assembly of claim 2 wherein said gland means includes: washer means positioned between said sealing means and said compression nut means.

4. The assembly of claim 1 including:

a pair of connector elements respectively being attached to a first end of a pair of cables to be connected; and hub means, said hub means being associated with said first ends of said cables, said hub means being positioned between said gland means and said cables, said hub means having a diameter at least equal to the diameter of said connector elements.

5. The assembly of claim 1 wherein: said housing is substantially comprised of a material selected from the group consisting of brass, steel and glass reinforced plastic.

6. The assembly of claim 1 wherein each of said gland means includes:

cylindrical gland housing means, said gland housing means comprising a flanged element having first and second threads;

cylindrical compression nut means having threads thereon to threadingly engage said second threads on said gland housing means; and said cylindrical sealing means being positioned between said compression nut means and said gland housing means wherein said compression nut means may be tightened with said gland housing means to urge said sealing means into a compressive seal with the cables.

7. The assembly of claim 6 including: cylindrical gland adapter means, said gland adapter means being positioned between said housing and said gland means.

8. The assembly of claim 7 wherein: said gland adapter means is integrally attached to said gland means and threadably connected to said housing.

9. The assembly of claim 7 wherein: said gland adapter means is threadably attached at one end to said gland means and at the other end to said housing.

* * * * *